US005669052A

United States Patent [19]

Kusaba et al.

[11] Patent Number: 5,669,052

[45] Date of Patent: Sep. 16, 1997

[54] IMAGE FORMING APPARATUS AND INTERMEDIATE TRANSFER MEMBER

[75] Inventors: Takashi Kusaba, Kodaira; Hiroyuki Kobayashi, Fuji; Akihiko Nakazawa, Shiroyamamachi; Atsushi Tanaka; Tsunenori Ashibe, both of Yokohama, all of Japan

[73] Assignee: Canon Kabushiki Kaisha, Tokyo, Japan

[21] Appl. No.: 658,625

[22] Filed: Jun. 5, 1996

[30] Foreign Application Priority Data

Jun. 6, 1995 [JP] Japan ..... 7-139330

[51] Int. Cl.[6] ..... G03G 15/16

[52] U.S. Cl. ..... 399/308; 492/56

[58] Field of Search ..... 399/308, 302, 399/297; 430/124, 126; 428/195, 914; 492/16–18, 20, 24–26, 53–54, 56

[56] References Cited

U.S. PATENT DOCUMENTS

| | | | |
|---|---|---|---|
| 4,000,942 | 1/1977 | Ito et al. . | |
| 4,804,576 | 2/1989 | Kuge et al. | 428/216 |
| 4,842,944 | 6/1989 | Kuge et al. | 428/451 |
| 4,883,715 | 11/1989 | Kuge et al. | 428/421 |
| 5,115,281 | 5/1992 | Ohtsuka et al. . | |
| 5,225,881 | 7/1993 | Goto et al. . | |
| 5,260,759 | 11/1993 | Kobayashi . | |
| 5,291,254 | 3/1994 | Shimada et al. . | |
| 5,376,448 | 12/1994 | Suzuki et al. | 492/56 X |
| 5,399,436 | 3/1995 | Takayama et al. | 428/195 X |
| 5,556,693 | 9/1996 | Yamane et al. | 428/195 |
| 5,577,443 | 11/1996 | Songer | 492/56 X |

FOREIGN PATENT DOCUMENTS

| | | |
|---|---|---|
| 0 716 355 A1 | 6/1996 | European Pat. Off. . |
| 0 715 229 A1 | 6/1996 | European Pat. Off. . |
| 63-301960 | 12/1988 | Japan . |
| WO 92/00554 | 1/1992 | WIPO . |
| WO 93/06533 | 4/1993 | WIPO . |

*Primary Examiner*—Matthew S. Smith

*Attorney, Agent, or Firm*—Fitzpatrick, Cella, Harper & Scinto

[57] ABSTRACT

An image forming apparatus includes a first image-forming member such as an electrophotographic photosensitive member, and an intermediate transfer member for receiving an image formed on the first image-bearing member and transferring the image onto a second image-bearing member such as plain paper. The intermediate transfer member has a surface layer comprising a binder and a powder dispersed therein. The binder is adjusted to have a tensile strength of at least 300 kg-f/cm$^2$, an elongation of at least 150%, and a tensile stress of at most 250 kg-f/cm$^2$ at an elongation of 100%. The powder may be a lubricating powder or an electroconductive powder.

11 Claims, 3 Drawing Sheets

IMAGE FORMING APPARATUS AND INTERMEDIATE TRANSFER MEMBER

FIELD OF THE INVENTION AND RELATED ART

The present invention relates to an image forming apparatus, particularly an image forming apparatus, such as a copying machine, a printer and a facsimile apparatus, of a type wherein an image formed on a first image-bearing member is once transferred to an intermediate transfer member (primary transfer), and then further transferred to a second image-bearing member (secondary transfer). The present invention further relates to an intermediate transfer member used in such an image forming apparatus.

The above-mentioned type of image forming apparatus using an intermediate transfer member is effective as a multi-color image forming apparatus for synthetically reproducing a multi-color image product by sequentially transferring a plurality of component color images in lamination based on multi-color image data, thereby to provide a multi-color image free from deviation (color deviation) among the respective component color images.

FIG. 1 shows an outline of an example of image forming apparatus using a drum-shaped intermediate transfer member.

The image forming apparatus shown in FIG. 1 is a full-color image forming apparatus (copying machine or laser beam printer) using an electrophotographic process and including an elastic roller 20 of a medium resistivity as an intermediate transfer member.

The image forming apparatus further includes a rotating drum-type electrophotographic photosensitive member (hereinafter simply called "photosensitive member") repetitively used as a first image-bearing member, which is driven in rotation in an arrow direction at a prescribed peripheral speed (process speed).

During the rotation, the photosensitive member 1 is uniformly charged to a prescribed potential of a prescribed polarity by a primary charger (corona discharger) 2 and then receives imagewise exposure light from an imagewise exposure means (not shown) (such as a color separation-focusing exposure optical system for a color original image, or a scanning exposure optical system including a laser scanner for outputting a laser beam modulated corresponding to time-serial electrical digital image signals based on image data). As a result, an electrostatic latent image corresponding to a first color component image (e.g., magenta component image) to an objective color image is formed on the photosensitive member 1.

Then, the electrostatic latent image is developed into a magenta component image (as a first color component image) by a first developing device (magenta developing device). At this time, second to fourth developing devices, i.e., a cyan developing device 42, a yellow developing device 43 and a black developing device 44, are not operated, thus not acting on the photosensitive member 1, so that the first color magenta component image is not affected by the second to fourth developing devices 42–44.

An intermediate transfer member 20 includes a cylindrical support member 21 and an elastic layer 22 formed around the outer periphery thereof, and driven in rotation in an indicated arrow direction at a peripheral speed identical to that of the photosensitive member 1.

The first color magenta component image formed on the photosensitive member 1 is sequentially primary-transferred to the outer periphery of the intermediate transfer member 20 while it passes through a nip between the photosensitive member 1 and the intermediate transfer member 20 under the action of an electric field formed by a primary transfer bias (voltage) applied to the intermediate transfer member 20.

The surface of the photosensitive member 1 after transfer of the first color magenta toner image is cleaned by a cleaning device 14.

Thereafter, in similar manners, a second color cyan component image, a third color yellow component image and a fourth color black component image are sequentially transferred in superposition onto the intermediate transfer member 20 to form a full color image corresponding to an objective color image thereon.

The transfer bias for sequentially transferring the first to fourth color toner images from the photosensitive member 1 in superposition onto the intermediate transfer member 20 is of a polarity opposite to that of the toner and is applied from a bias supply 28. The applied voltage therefor is, e.g., in the range of +2 to +5 kV (or −2 to −5 kV).

The image forming apparatus further includes a transfer roller 25, which is supported on a shaft in parallel with the intermediate transfer member 20 so as to contact the lower surface thereof. However, the transfer roller 25 and an intermediate transfer member cleaner 35 can be disposed in separation from the intermediate transfer member 20 during the steps for transferring the first to fourth color toner images from the photosensitive member 1 to the intermediate transfer member 20.

The full-color toner image superposedly transferred onto the intermediate transfer member 20 is secondary-transferred to a transfer(-receiving) material (second image-bearing member) 24 by causing the transfer roller 25 to abut against the intermediate transfer member 20, supplying the transfer material 24 from a paper supply cassette 9 to the abutting position between the intermediate transfer member 20 and the transfer roller 25 at prescribed time and simultaneously by applying a secondary transfer bias to the transfer roller 25. The transfer material 24 bearing the transferred toner image is then introduced to a fixing device 15 for hot fixing of the toner image.

After the completion of the image transfer onto the transfer material 24, a transfer residual toner on the intermediate transfer member 20 is cleaned by an intermediate transfer member cleaner 35 abutting the intermediate transfer member 20.

The above-mentioned image forming apparatus using an intermediate transfer member is advantageous than an image forming apparatus wherein images are transferred from a first image-bearing member onto a second image-bearing member attached onto or attracted by a transfer drum (e.g., as disclosed in Japanese Laid-Open Patent Application (JP-A) 63-301960) in the following respects:

(a) Little color deviation occurs during superposition of respective color images.

(b) As is understood from FIG. 1, no means is required for processing or controlling the second image-bearing member (e.g., gripping by a gripper, attracting, providing a curvature, etc.), so that a wide variety of second image-bearing member can be used. For example, it is possible to use from a thin paper of ca. 40 g/m$^2$ to a thick paper of ca. 200 g/m$^2$ equally as a second image-bearing member. Further, the transfer can be performed regardless of a difference in width and/or length of the second image-bearing member, so that it is applicable to even an envelope, a post-card or a label paper.

Such an intermediate transfer member is required to exhibit an excellent transfer efficiency so as not to result in a hollow dropout image as shown in FIG. 5.

In order to comply with such a requirement, an intermediate transfer member having a surface layer containing electroconductive powder has been disclosed in, e.g., U.S. Pat. No. 5,291,254. According to our study, it has been also found effective for providing an improved transfer efficiency to use a surface layer containing a lubricating powder dispersed therein. A further requirement is to retain excellent performances for a longer period.

SUMMARY OF THE INVENTION

Accordingly, a principle object of the present invention is to provide an image forming apparatus including an intermediate transfer member capable of exhibiting an excellent transfer efficiency for a long period, and also such an intermediate transfer member.

According to the present invention there is provided an image forming apparatus, comprising: a first image-forming member, and an intermediate transfer member for receiving an image formed on the first image-bearing member and transferring the image onto a second image-bearing member;

wherein said intermediate transfer member has a surface layer comprising a binder and a powder dispersed therein; the binder having a tensile strength of at least 300 kg-f/cm$^2$ an elongation of at least 150%, and a tensile stress of at most 250 kg-f/cm$^2$ at an elongation of 100%.

According to another aspect of the present invention, there is provided an intermediate transfer member as described above for use in the above-mentioned image forming apparatus.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
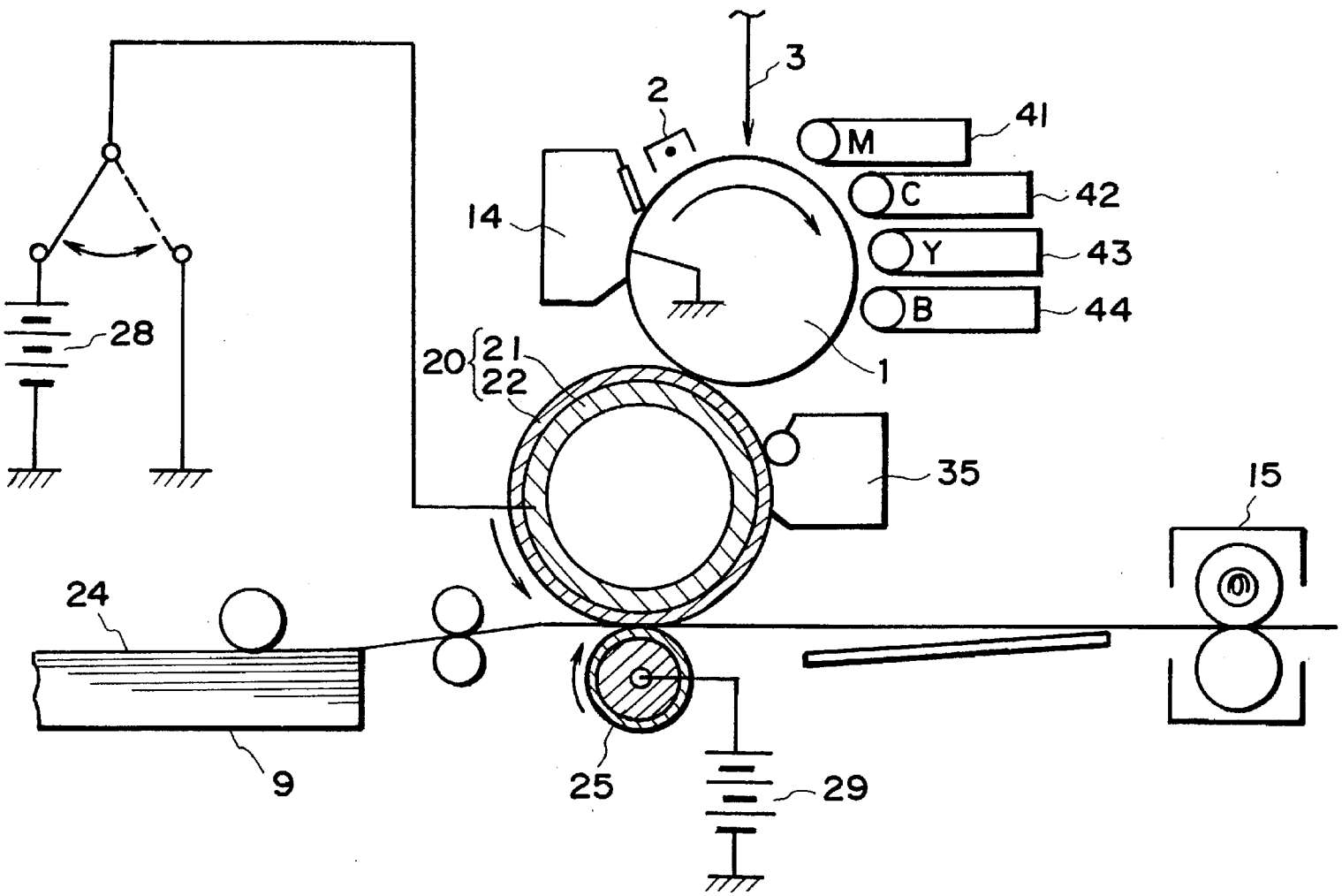
FIG. 1 is an illustration of an image forming apparatus including an intermediate transfer member.

As described above, the image forming apparatus according to the present invention comprises a first image-forming member, and an intermediate transfer member for receiving an image formed on the first image-bearing member and transferring the image onto a second image-bearing member. The intermediate transfer member has a surface layer comprising a binder and a powder dispersed therein, wherein the binder has a tensile strength of at least 300 kg-f/cm$^2$, an elongation of at least 150%, and a tensile stress of at most 250 kg-f/cm$^2$ at an elongation of 100%, as measured according to JIS K6301.

Because of the above-mentioned physical properties of the binder in the surface layer of the intermediate transfer member, the surface layer may be formed as a resilient and tough coating layer free from brittleness even if it contains a large amount of modifier powder. It is particularly preferred in the present invention that the binder has a tensile strength of at least 400 kg-f/cm$^2$, an elongation of at least 250% and a tensile stress of at most 200 kg-f/cm$^2$ at 100%-elongation; further preferably a tensile strength of at last 450 kg-f/cm$^2$, an elongation of at least 350% and a tensile stress of at most 150 kg-f/cm$^2$ at 100%-elongation. When a binder failing to satisfy the above-mentioned physical properties (tensile properties) is contained in a surface layer of an intermediate transfer member, the surface layer is liable to be brittle or weak and is liable to cause difficulties, such as roughening and cracking, and also a lowering in transfer efficiency.

A larger tensile strength and a larger elongation are preferred so that no upper limit need not be provided for these properties. The tensile stress at 100%-elongation may preferably be at leaset 10 kg-f/cm$^2$. If the tensile stress is excessively small, the toner image on the intermediate transfer member after the primary transfer is liable to be embedded at the surface, thus lowering the secondary transfer efficiency.

As far as the above-mentioned properties are satisfied, the binder material may comprise any of a rubber or elastomer and a resin, examples of which may include: elastomers or rubbers, such as styrene-butadiene rubber, high-styrene rubber, butadiene rubber, isoprene rubber, ethylene-propylene copolymer, nitrile-butadiene rubber, chloroprene rubber, butyl rubber, silicone rubber, fluorine-containing rubber, nitrile rubber, urethane rubber, acrylic rubber, epichlorohydrin rubber, and norbornene rubber; and resins, such as styrene-based resins (homopolymers and copolymers of styrene and substituted styrene inclusive of polystyrene, chloropolystyrene, poly-α-methylstyrene, styrene-butadiene copolymer, styrene-vinyl chloride copolymer, styrene-vinyl acetate copolymer, styrene-maleic acid copolymer), styrene-acrylate copolymers (such as styrene-methyl acrylate copolymer, styrene-ethyl acrylate copolymer, styrene-butyl acrylate copolymer, styrene-octyl acrylate copolymer, and styrene-phenyl acrylate copolymer), styrene-methacrylate copolymers (such as styrene-methyl methacrylate copolymer, styrene-ethyl methacrylate copolymer and styrene-phenyl methacrylate copolymer), styrene-methyl α-chloroacrylate copolymer, and styrene-acrylonitrile-acrylate copolymers; vinyl chloride resin, styrene-vinyl acetate copolymer, rosin-modified maleic acid resin, phenolic resin, polyester resin, low-molecular weight polyethylene, low-molecular weight polypropylene, ionomer resins, polyurethane resin, silicone resin, ketone resin, ethylene-ethyl acrylate copolymer, xylene resin, fluorine-containing resin, polycarbonate resin, polyamide resin, and polyvinyl butyral resin. These rubbers or elastomers, and resins can also be used in combination of two or more species. Among these, urethane rubber or elastomer and urethane resin are particularly preferred because of excellent powder-retaining characteristic.

In order for the rubber, elastomer or resin to exhibit the above-mentioned physical properties, the rubber, elastomer or resin may preferably be prepared to have appropriate composition and molecular weight through an appropriate process. For example, a larger molecular weight provides a larger elongation and a smaller tensile stress. Further, a large degree of crosslinkage obtained, e.g., by adjustment of a hardening agentm results in a larger tensile strength, a smaller elongation and a larger tensile stress at 100%-elongation. However, in the present invention, it is essential for the binder to exhibit the above-mentioned physical properties, and specific measures for providing the physical properties are not restrictive in the present invention.

The modifier powder to be contained in the surface layer of the intermediate transfer member may be lubricating powder or/and electroconductive powder. In order to provide a good transfer efficiency, the surface layer may preferably contain at least a lubricating powder which may comprise powder of an lubricity-imparting material. The lubricity-imparting ability of a powder sample may be evaluated according to the following method.

20 wt. parts of a test powder and 100 wt. parts (solid) of urethane prepolymer are diluted with ca. 100 wt. parts of solvent blended under stirring, 5 wt. parts of a hardening agent is added there%o to be mixed, and the resultant paint mixture is applied by spray coating onto a PET (polyethylene terephthalate sheet) to form a test piece. The viscosity of the paint mixture is adjusted so as to form a smooth coating surface by dilution with a solvent mixture of toluene and MEK (methyl ethyl ketone). Separately, a comparative piece is prepared in the same manner as above except above except for omitting the test powder. Then, each of the test piece and the comparative piece is subjected to measurement of a slippage resistance with a surface tester ("HEIDON 14-DR", available from Shintoh Kagaku K.K.) by rubbing the coating surface of the piece with a non-coated PET sheet fixed about an ASTM planar pressing member (63.5 mm×63.5 mm, according to ASTM D1894) while horizontally moving the PET sheet at a speed of 100 mm/min under a vertical load of 200 g-f applied via the pressing member. If the test piece shows a slippage resistance which is at most 80% that of the comparative piece, the test powder may be classified as a lubricating powder.

Preferred but non-limitative examples of the lubricating powder may include: particulate carbon materials, such as graphite, fluorinated carbon and spherical graphite; powders of resins, such as tetrafluoroethylene resin, trifluorochloroethylene resin, hexafluoropropylene resin, vinyl fluoride resin, vinylidene fluoride resin, difluorodichloroethylene resin, copolymers of the above resins, fluorinated carbon, silicone resin, silicone rubber, silicone elastomer, polyethylene (PE), polypropylene (PP), polystyrene (PS), acrylic resin, nylon resin, phenolic resin and epoxy resin; and powders of inorganic substance, such as silica, alumina, titanium oxide, magnesium oxide, tin oxide and iron oxide. These may be used singly or in combination of two or more species. Among these, tetrafluoroethylene resin is particularly preferred.

The lubricating powder may basically comprise particles of any shape and size but may preferably have a particle size (diameter) of 0.02–50 μm in view of the dispersibility and surface characteristic. The lubricating powder can be surface-treated, as desired, within an extent of not adversely affecting the lubricating performance and can be used together with a dispersing agent within an extent of not adversely affecting the properties of the surface layer.

The lubricating powder may preferably be contained in a proportion of 40–80 wt. % of the total solid matter of the surface layer. Below 40 wt. % the lubricating effect can be insufficient to result in a gradual lowering in transfer efficiency, thus being liable to cause filming, in a continuous image formation. In excess of 80 wt. %, the adhesion with the binder can be insufficient to result in gradual dropping-off of the lubricating powder and surface roughening during a continuous image formation.

The electroconductive powder used in the present invention may comprise particles of various electroconductive inorganic materials, carbon black, electroconductive resins, and resins containing electroconductive particles dispersed therein. More specifically, examples of electroconductive inorganic particles may include: particles of titanium oxide, tin oxide, barium sulfate, aluminum oxide, strontium titanate, magnesium oxide, silicon oxide, silicon carbide and silicon nitride, optionally surface-coated with tin oxide, antimony oxide or carbon. Examples of the electroconductive resin may include: polymethyl methacrylate containing a quaternary ammonium salt, polyvinylaniline, polyvinylpyrrole, polydiacetylene and polyethyleneimine. Further, examples of the electroconductive particle-dispersed resin may include: resins, such as urethane, polyester, vinyl acetate-vinyl chloride copolymer, and polymethyl methacrylate containing electroconductive particles, such as particles of carbon, aluminum and nickel, dispersed therein. These electroconductive particles may have any shapes inclusive of sphere, fiber, plate and indefinite shape. Among the above, it is. particularly preferred to use electroconductive inorganic particles in view of electroconductivity-controlling performance.

Figure 2:
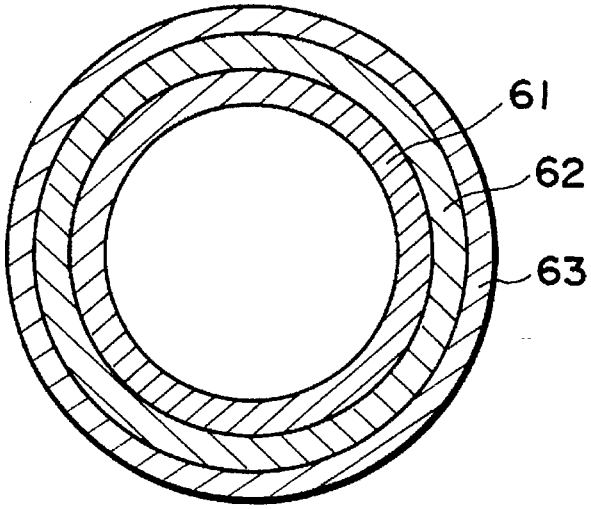
FIGS. 2 and 3 are illustrations of roller-shaped intermediate transfer members having a coating layer and plural coating layers, respectively, on the elastic layer.
Figure 3:
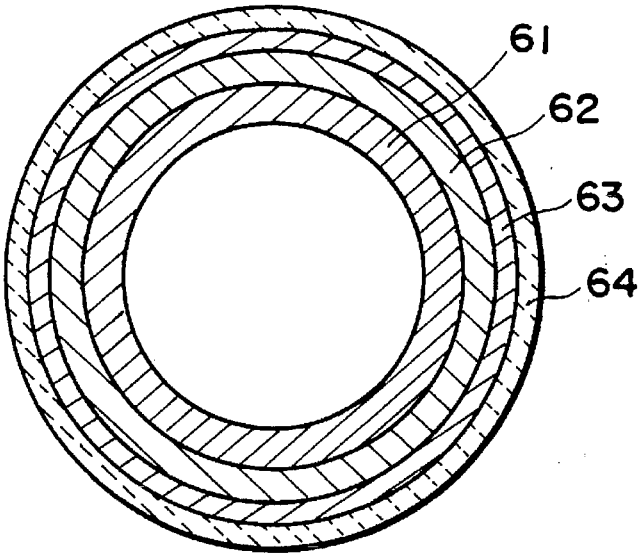
Figure 4:
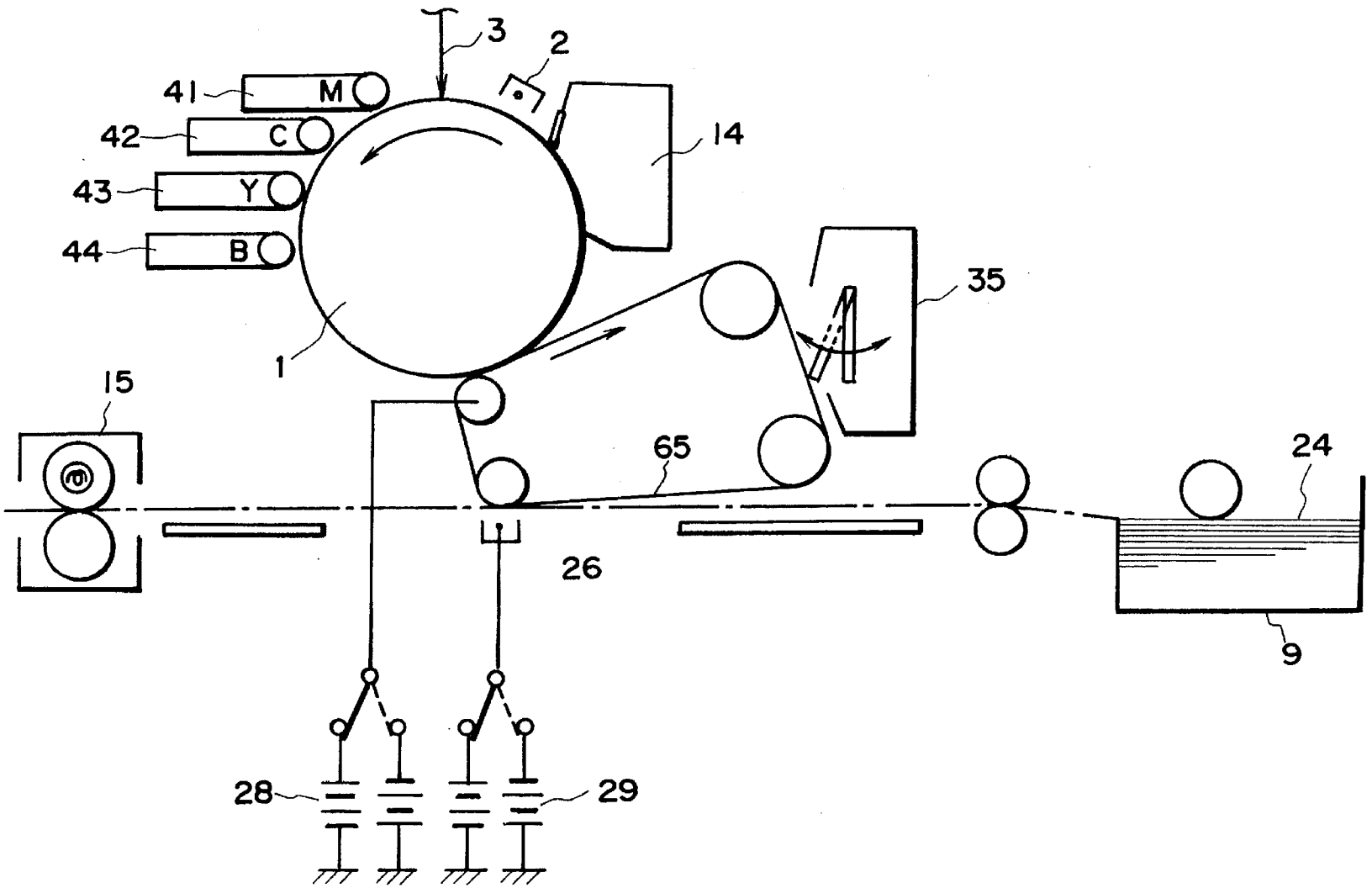
FIG. 4 is an illustration of an image forming apparatus including an intermediate transfer member in the form of an endless belt.

The intermediate transfer member used in the present invention may assume various forms, inclusive of: a drum comprising a cylindrical electroconductive support (core metal) 61 of which the outer peripheral surface is coated successively with an elastic layer 62 comprising a rubber, elastomer or resin and a single coating layer 63 (FIG. 2); a drum comprising a core metal 61 and an elastic layer 62 further coated with two layers of coating layers 63 and 64 (FIG. 3); and an endless belt 65 (as shown in FIG. 4 showing an image forming apparatus including a transfer charger 65 and other members similar to those shown in FIG. 1). These various forms of intermediate transfer member may be selected as desired depending on the purpose. In any case, the uppermost layer is constituted as the surface layer comprising the binder and the powder according to the present invention. In the present invention, it is preferred to use a drum- or roller-shaped intermediate transfer member in view of little color deviation during superposition of images and durability in repetitive use. On the other hand, an intermediate transfer member in the form of an endless belt is advantageous in providing a smaller size of image forming apparatus.

The electroconductive support (e.g., 61 in FIG. 2 or 3) may preferably comprise a metal or alloy, such as aluminum, iron, copper or stainless steel, or an electroconductive resin containing electroconductive carbon or metal particles. The support may have a shape of a drum or an endless belt as described above, inclusive of a drum equipped with a shaft piercing therethrough and a cylindrical bar.

The elastic layer (62) may comprise a binder of a rubber or elastomer or a resin similar to the one constituting the surface layer but the binder need not satisfy the properties of the one in the surface layer. The elastic layer (62) can contain an ionic electroconductive substance, such as an ammonium salt, an alkylsulfonic acid salt, a phosphonic acid ester or a perchloric acid salt in place of or in addition to the electroconductive powder described above. This also holds true with a coating layer (63 in FIG. 3) not forming the surface layer.

The elastic layer (62) may preferably have an appropriate degree of elasticity, e.g., a JIS A rubber hardness (JIS K6301) of 20–80 deg., so as to allow the intermediate transfer member to uniformly contact the first and second image-bearing members.

The elastic layer (62) may preferably have a thickness of at least 0.5 mm, more preferably, at least 1 mm, further preferably 1–10 mm. On the other hand, the coating layer (63 or 64) may preferably be thin so as to conduct the softness of the lower elastic layer to the upper layer (64) or to the surface of the intermediate transfer member and more specifically have a thickness of at most 3 mm, more preferably at most 2 mm, further preferably 20 μm–1 mm.

The intermediate transfer member according to the present invention may preferably exhibit a resistance (as measured in the manner described in Example 1 or 4 described hereinafter) in the range of $10^1$–$10^{13}$ ohm, more preferably $10^2$–$10^{10}$ ohm. It is particularly preferred that at least the surface layer has a resistance in the above-mentioned range.

The intermediate transfer member according to the present invention may for example be prepared in the following manner.

A metal drum (61) as a cylindrical electroconductive support (core metal) is provided, and an elastic layer (62) is formed on the metal drum by melt-forming, casting, dip-coating or spray coating of a binder, such as rubber, elastomer or resin, together with a filler. Then, after forming a lower coating layer (63 in FIG. 3), if any, the surface layer (63 in FIG. 2 or 64 in FIG. 3) is formed by melt-forming, casting, dip-coating or spray-coating of the material thereof including the binder and the modifier powder, and optionally a solvent or dispersion medium.

The first image-bearing member in the image forming apparatus according to the present invention may comprise an ordinary electrophotographic photosensitive member but preferably be a photosensitive member having a protective layer containing particles of a fluorine-containing resin, such as polytetrafluoroethylene on the photosensitive layer. By providing such a protective layer, the performance of primary transfer from the photosensitive member to the intermediate transfer member may be improved to provide good images free from transfer hollow dropout and a high primary transfer efficiency. On the other hand, if the intermediate transfer member does not exhibit a good secondary transfer characteristic, the transfer residual toner on the intermediate transfer member is increased, so that a substantial improvement in transfer efficiency cannot be expected but image defects, such as hollow dropout due to secondary transfer failure, are caused. The intermediate transfer member according to the present invention is free from such problems and can provide remarkable improvements in transfer efficiency and image quality in combination with a photosensitive member having such a protective layer.

The second image-bearing member used in the present invention may for example comprise paper of various types and OHP sheet.

Hereinbelow, the present invention will be described more specifically with reference to Examples and Comparative Examples, wherein "part(s)" used for describing a composition means "part(s) by weight".

EXAMPLE 1

On an aluminum cylinder (outer diameter (OD)=182 mm, length (L)=320 mm, thickness (T)=3 mm), a rubber compound of the following composition was transfer-molded to prepare a roller (1) having an elastic layer.

| (Rubber compound) | |
|---|---|
| NBR (nitrile rubber) | 100 parts |
| Zinc oxide | 2 parts |
| Electroconductive carbon black | 12 parts |

-continued

| (Rubber compound) | |
|---|---|
| Paraffin oil | 25 parts |
| Vulcanizing agent | 2 parts |
| Vulcanization promoter | 3 parts |

Separately, a surface layer paint of the following composition was prepared.

| (Surface layer paint) | |
|---|---|
| Polyester polyurethane elastomer (pellet) | 100 parts |
| Tetrafluoroethylene resin powder (average particle size (Dav = 0.3 μm) | 300 parts |
| Electroconductive titanium oxide powder (Dav = 0.5 μm) | 40 parts |
| Dispersion aid | 15 parts |
| DMF (dimethylformamide) | 1200 parts |

The paint was applied by spraying onto the outer surface of the roller (1) and dried by heating at 120° C. for 2 hours to form an intermediate transfer member having an 80 μm-thick tough surface layer. The tetrafluoroethylene powder occupied 66 wt. % of the total solid components of the surface layer.

The polyester polyurethane elastomer (pellet) used as the binder in the above paint was separately heat-molded into a sheet, which was then stamped into a dumbbell test piece (No. 3 test piece according to JIS K6301), which was then subjected to a tensile test according to JIS K6301, whereby the binder sample showed a tensile strength of 500 kg-f/cm$^2$ an elongation of 520% and a tensile stress at 100%-elongation of 90 kg-f/cm$^2$.

In an environment of temperature of 23° C. and relative humidity of 65%, the above-prepared intermediate transfer member was placed on an aluminum sheet of 350 mm×200 mm so that the surface layer contacted the aluminum sheet, and a voltage of 1 kV was applied from a high-voltage power supply between the aluminum cylinder (as a support) of the aluminum sheet to measure a potential difference across a resistor of 1 k-ohm connected in series with the power supply from which a current through the resistor was calculated to finally obtain a resistance of $1.0\times10^7$ ohm of the intermediate transfer member (i.e., a resistance across the elastic layer and the surface layer).

The intermediate transfer member was incorporated in a full-color electrophotographic apparatus as shown in FIG. 1 including an OPC photosensitive member (1, as a first image-bearing member) having a photosensitive layer and a protective layer thereon, and subjected to measurement of transfer efficiencies according to a mono-color mode using a cyan toner, thereby to obtain a primary transfer efficiency (from the photosensitive member to the intermediate transfer member) of 94% and a secondary transfer efficiency (from the intermediate transfer member to plain paper of 80 g/m$^2$ (as a secondary image-bearing member)) of 92%.

For the measurement, the image densities of a transfer residual image on the photosensitive member and a transferred image on the intermediate transfer member were measured for determining a primary transfer efficiency, and the image densities of a transfer residual image and a transferred image on the plain paper were measured for determining a secondary transfer efficiency, respectively by using a Macbeth reflection densitometer ("RD-918", available from Macbeth Co.). More specifically, each of the toner images was recovered by applying a cellophane adhesive tape thereon and peeling the toner image together with the adhesive tape. Then, the adhesive tape carrying the toner image and a blank adhesive tape carrying no toner (as a reference sample) were respectively applied on white paper, and the reflection densities of these samples were measured by the densitometer to determine an image density as a difference between the measured reflection densities. From the measured image densities, the respective transfer efficiencies were calculated according to the following equations.

Primary transfer efficiency (%)=[(Image density on the intermediate transfer member)/(Residual image density on the photosensitive member+Image density on the intermediate transfer member)]×100 Secondary transfer efficiency (%) =[(Image density on the plain paper)/(Residual image density on the intermediate transfer member +Image density on the plain paper)]×100

Then, by using the image forming apparatus, a continuous full-color image forming test was performed of plain paper of 80 g/m$^2$ on 40,000 sheets/under the following conditions.

Photosensitive member: OPC photosensitive member having a laminar structure of an electroconductive support, an undercoating layer, a charge generation layer, a charge transportation layer and a protective layer containing tetrafluoroethylene resin powder.

Dark part potential: −750 volts

Developer: non-magnetic mono-component toners of four colors (cyan, magenta, yellow and black)

Developing bias voltage: −450 volts.

Primary transfer voltage: +1.0 kV

Secondary transfer voltage: +4.0 kV

Process speed: 120 mm/sec

As a result, the resultant character images and thin line images were free from hollow dropout, and solid images were also formed uniformly, respectively, as a result of evaluation by eye observation. Even after the 40,000 sheets of continuous image formation, images similar to those at the initial stage were obtained. After the test, the surface of the intermediate transfer member was inspected, whereby no peeling or crack was observed at the surface layer, and no toner filming was observed either.

The evaluation results are shown in Table 1 appearing hereinafter together with the results of other Examples. The hollow dropout and filming in Table 1 were evaluated at four levels of A (very good), B (good), C (acceptable for practical use) and D (unacceptable for practical use). The inspection results of the intermediate transfer member are supplemented after Table 1.

EXAMPLE 2

| (Surface layer paint) | |
|---|---|
| Polyamide elastomer | 100 parts |
| Tetrafluoroethylene resin powder (Dav = 0.3 μm) | 300 parts |
| Electroconductive titanium oxide powder (Dav = 0.5 μm) | 40 parts |
| Dispersion aid | 15 parts |
| Propanol | 1000 parts |

The above paint was applied by spraying onto the outer surface of a roller (1) similar to the one prepared in Example 1 and dried by heating at 100° C. for 2 hours to form an intermediate transfer member having a 90 μm-thick tough surface layer. The tetrafluoroethylene resin content in the surface layer was 66 wt. %. As a result of separate sample formation similarly as in Example 1, the binder polyamide elastomer showed a tensile strength of 430 kg-f/cm$^2$, an elongation of 310% and a tensile stress at 100%-elongation of 140 kg-f/cm$^2$.

The intermediate transfer member was evaluated in the same manner as in Example 1. The results are shown in Table 1.

EXAMPLE 3

| (Surface layer paint) | |
|---|---|
| Polyester polyurethane prepolymer solution | 100 parts |
| Hardener solution | 30 parts |
| Tetrafluoroethylene resin powder (Dav = 0.3 μm) | 100 parts |
| Electroconductive titanium oxide powder (Dav = 0.5 μm) | 15 parts |
| Dispersion aid | 5 parts |
| Toluene | 80 parts |

The above paint was applied by spraying onto the outer surface of a roller (1) similar to the one prepared in Example 1 and dried and cured by heating at 100° C. for 1 hour to form an intermediate transfer member having an 85 μm-thick tough surface layer. The tetrafluoroethylene resin content in the surface layer was 66 wt. %. Separately, the prepolymer solution and the hardener solution in the above-mentioned resin was dried and cured into a resin sheet, which was stamped into a No. 3 dumbbell test piece (JIS K6301) and subjected to a tensile test similarly as in Example 1. As a result, the cured binder polyester polyurethane showed a tensile strength of 340 kg-f/cm$^2$, an elongation of 230% and a tensile stress at 100%-elongation of 210 kg-f/cm$^2$.

The intermediate transfer member was evaluated in the same manner as in Example 1. The results are shown in Table 1.

EXAMPLE 4

The surface layer paint prepared in Example 1 was applied onto the surface of an endless belt formed from a composition of 100 wt. parts of vinylidene fluoride resin and 2.0 wt. parts of electroconductive carbon black and dried at 120° C. for 2 hours to form an intermediate transfer member in the form of an endless belt having an 80 μm-thick surface layer.

The resistance of the intermediate transfer member was measured by placing the intermediate transfer member on an aluminum sheet similar to the one used in Example 1, inserting an aluminum bar having a weight of 1 kg and a length equal to the width of the intermediate transfer member, and then measuring a current passing between the aluminum sheet and the aluminum bar otherwise similarly as in Example 1, whereby the intermediate transfer member showed a resistance of 1.4×10$^7$ ohm.

The intermediate transfer member (65) was incorporated in a full-color electrophotographic apparatus as shown in FIG. 1 and evaluated otherwise in the same manner as in Example 1. The results are shown in Table 1.

EXAMPLE 5

An intermediate transfer member was prepared and evaluated in the same manner as in Example 1 except that the tetrafluoroethylene resin (PTFE) powder was replaced by silicone resin powder. The results are shown in Table 1.

EXAMPLE 6

An intermediate transfer member was prepared and evaluated in the same manner as in Example 1 except that the tetrafluoroethylene resin (PTFE) powder was increased in amount to provide a content of 83 wt. % in the resultant surface layer. The results are shown in Table 1.

EXAMPLE 7

An intermediate transfer member was prepared and evaluated in the same manner as in Example 1 except that the tetrafluoroethylene resin (PTFE) powder was decreased in amount to provide a content of 37 wt. % in the resultant surface layer. The results are shown in Table 1.

EXAMPLE 8

An intermediate transfer member was prepared and evaluated in the same manner as in Example 3 except that the polyester polyurethane prepolymer was replaced by polyester polyurethane prepolymer and the hardener solution was increased to 40 parts. The tetrafluoroethylene resin powder content in the resultant surface layer was 65 wt. %. The binder in the surface layer showed a tensile strength of 350 kg-f/cm$^2$, an elongation of 330% and a tensile stress at 100%-elongation of 160 kg-f/cm$^2$. The results are also shown in Table 1.

COMPARATIVE EXAMPLE 1

An intermediate transfer member was prepared and evaluated in a similar manner as in Example 3 except that the hardener solution was increased in amount to 70 parts. The resultant surface layer had a thickness of 70 μm and a tetrafluoroethylene resin powder content of 63 wt. %. The binder showed a tensile strength of 420 kg-f/cm$^2$, an elongation of 130% and a tensile stress at 100%-elongation of 340 kg-f/cm$^2$.

The intermediate transfer member was evaluated in the same manner as in Example 1. The results are shown in Table 1.

COMPARATIVE EXAMPLE 2

| (Surface layer paint) | |
|---|---|
| Silicone resin solution | 100 parts |
| Tetrafluoroethylene resin powder (Dav = 0.3 μm) | 80 parts |
| Electroconductive titanium oxide powder (Dav = 0.5 μm) | 10 parts |
| Dispersion aid | 4 parts |
| Toluene | 80 parts |

The above paint was applied by spraying onto the outer surface of a roller (1) similar to the one prepared in Example 1 and dried by heating at 100° C. for 2 hours. As a result, the resultant surface layer was accompanied with cracks, so that further evaluation was not performed. The tetrafluoroethylene resin powder content in the surface layer was 55%. The silicone resin binder showed a tensile strength of 80 kg-f/cm$^2$ and an elongation of 50%, so that the tensile stress at 100%-elongation could not be measured.

COMPARATIVE EXAMPLE 3

An intermediate transfer member was prepared and evaluated in the same manner as in Example 3 except that the hardener solution was increased in amount to 50 parts. The resultant surface layer had a tetrafluoroethylene resin powder content of 64 wt. %. The binder showed a tensile strength of 400 kg-f/cm$^2$, an elongation of 170% and a tensile stress at 100%-elongation of 280 kg-f/cm$^2$. The results are shown in Table 1.

COMPARATIVE EXAMPLE 4

An intermediate transfer member was prepared and evaluated in the same manner as in Example 3 except that the hardener solution was decreased in amount to 10 parts. The resultant surface layer had a tetrafluoroethylene resin powder content of 67 wt. %. The binder showed a tensile strength of 250 kg-f/cm$^2$, an elongation of 340% and a tensile stress at 100%elongation of 110 kg-f/cm$^2$.

The intermediate transfer member was evaluated in the same manner as in Example 1. The results are shown in Table 1.

COMPARATIVE EXAMPLE 5

An intermediate transfer member was prepared and evaluated in the same manner as in Example 3 except that the hardener solution was increased in amount to 80 parts. The resultant surface layer had a tetrafluoroethylene resin powder content of 62 wt. %. The binder showed a tensile strength of 370 kg-f/cm$^2$, an elongation of 140% and a tensile stress at 100%-elongation of 240 kg-f/cm$^2$.

The intermediate transfer member was evaluated in the same manner as in Example 1. The results are shown in Table 1.

TABLE 1

| | Surface layer property | | | Lubricating powder | | | Transfer efficiency | | | |
|---|---|---|---|---|---|---|---|---|---|---|
| | Tensile strength (kf-f/cm$^2$) | Elongation (%) | Tensile stress (kg-f/cm$^2$) | Species | Content (%) | Resistance (Ω) | 1st | 2nd | Hollow dropout | Filming |
| Ex. 1 | 500 | 520 | 90 | PTFE | 66 | $1.0 \times 10^7$ | 94 | 92 | A | A |
| 2 | 430 | 310 | 140 | PTFE | 66 | $3.1 \times 10^7$ | 93 | 93 | A | A |
| 3 | 340 | 230 | 210 | PTFE | 66 | $5.3 \times 10^5$ | 93 | 92 | A | A |
| 4 | 500 | 520 | 90 | PTFE | 66 | $1.4 \times 10^7$ | 91 | 90 | A | A |
| 5 | 500 | 520 | 90 | Silicone | 66 | $8.7 \times 10^5$ | 92 | 90 | A | B |

TABLE 1-continued

| | Surface layer property | | | | | | | | | |
|---|---|---|---|---|---|---|---|---|---|---|
| | Tensile strength (kf-f/cm$^2$) | Elongation (%) | Tensile stress (kg-f/cm$^2$) | Lubricating powder Species | Content (%) | Resistance (Ω) | Transfer efficiency 1st | Transfer efficiency 2nd | Hollow dropout | Filming |
| | | | | resin | | | | | | |
| 6 | 500 | 520 | 90 | PTFE | 83 | $4.6 \times 10^5$ | 94 | 96 | B | B |
| 7 | 500 | 520 | 90 | PTFE | 37 | $4.2 \times 10^7$ | 91 | 88 | B | C |
| 8 | 350 | 330 | 160 | PTFE | 65 | $4.2 \times 10^6$ | 93 | 92 | A | A |
| Comp. Ex. 1 | 420 | 130 | 340 | PTFE | 63 | $6.4 \times 10^5$ | 92 | 91 | — | — |
| 2 | 80 | 50 | — | PTFE | 62 | — | — | — | — | — |
| 3 | 400 | 170 | 280 | PTFE | 64 | $9.5 \times 10^6$ | 93 | 93 | — | — |
| 4 | 250 | 340 | 110 | PTFE | 67 | $3.3 \times 10^6$ | 94 | 91 | — | — |
| 5 | 370 | 140 | 240 | PTFE | 62 | $5.5 \times 10^6$ | 93 | 93 | — | — |

Now, the results of evaluation by eye observation of the surface layers of the respective Examples and Comparative Examples are summarized below.

Example 1

No surface layer change was observed after the continuous image formation.

Example 2

Very slight crack was observed in the surface layer after the continuous image formation.

Example 3

Very slight crack was observed in the surface layer after the continuous image formation.

Example 4

Very slight crack was observed in the surface layer after the continuous image formation.

Example 5

Very slight filming was observed on the surface layer after the continuous image formation.

Example 6

Slight surface roughening was observed on the surface layer after the continuous image formation.

Example 7

Slight filming was observed on the surface layer after the continuous image formation.

Example 8

Very slight crack was observed in the surface layer after the continuous image formation.

Comparative Example 1

Crack occurred in the surface layer at the time of image formation on ca. 21,000 sheets, so that the continuous image formation was interrupted.

Comparative Example 2

Crack were observed in the surface layer after the preparation and before use of the intermediate transfer member.

Comparative Example 3

Crack occurred in the surface layer at the time of image formation on ca. 26,000 sheets, so that the continuous image formation was interrupted.

Comparative Example 4

Crack occurred in the surface layer at the time of image formation on ca. 19,000 sheets, so that the continuous image formation was interrupted.

Comparative Example 5

Crack occurred in the surface layer at the time of image formation on ca. 25,000 sheets, so that the continuous image formation was interrupted.

What is claimed is:

1. An image forming apparatus, comprising: a first image-forming member, and an intermediate transfer member for receiving an image formed on the first image-bearing member and transferring the image onto a second image-bearing member;

wherein said intermediate transfer member has a surface layer comprising a binder and a powder dispersed therein; the binder having a tensile strength of at least 300 kg-f/cm$^2$, an elongation of at least 150%, and a tensile stress of at most 250 kg-f/cm$^2$ at an elongation of 100%.

2. An image forming apparatus according to claim 1, wherein the binder has a tensile strength of at least 400 kg-f/cm$^2$ an elongation of at least 250% and a tensile stress at 100%-elongation of at most 200 kg-f/cm$^2$.

3. An image forming apparatus according to claim 2, wherein the binder has a tensile strength of at least 450 kg-f/cm$^2$ an elongation of at least 350% and a tensile stress at 100%-elongation of at most 150 kg-f/cm$^2$.

4. An image forming apparatus according to claim 1, wherein the binder has a tensile stress at 100%-elongation of at least 10 kg-f/cm$^2$.

5. An image forming apparatus according to claim 1, wherein the binder comprises a polyurethane resin.

6. An image forming apparatus according to claim 1, wherein the powder comprises at least one member selected from the group consisting of a lubricating powder and an electroconductive powder.

7. An image forming apparatus according to claim 6, wherein the powder comprises a lubricating powder.

8. An image forming apparatus according to claim 7, wherein the lubricating powder comprises tetrafluoroethylene resin.

9. An image forming apparatus according to claim 1, wherein the intermediate transfer member is in the form of a drum.

10. An image forming apparatus according to claim 1, wherein the intermediate transfer member is in the form of an endless belt.

11. An image forming apparatus according to claim 1, wherein the first image-bearing member is an electrophotographic photosensitive member.

* * * * *

UNITED STATES PATENT AND TRADEMARK OFFICE

CERTIFICATE OF CORRECTION

PATENT NO. : 5,669,052
DATED : September 16, 1997
INVENTOR(S) : Takashi KUSABE, et al.

Figure 5:
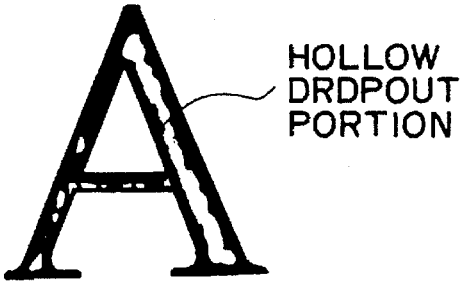
FIG. 5 is an illustration of a hollow dropout image.

It is certified that error appears in the above-identified patent and that said Letters Patent is hereby corrected as shown below:

FIG. 5:
delete "DRDPOUT" and insert therefor --DROPOUT--.

Column 2:
Line 47, after "is", insert --more--.

Column 4:
Line 18, delete "leaset" and insert therefor --least--;
Line 65, delete "agentm" and insert therefor --agent--.

Column 5:
Line 14, delete "there%o" and insert therefor --thereto--;
Line 21, delete "above except".

Column 9:
Lines 20 and 21, delete "of plain paper of 80 g/m$^2$";
Line 21, delete "sheets/under" and insert therefor --sheets of plain paper of 80 g/m$^2$ under--.

Signed and Sealed this

Seventeenth Day of March, 1998

Bruce Lehman

*Attest:*

BRUCE LEHMAN

*Attesting Officer*

*Commissioner of Patents and Trademarks*